US012458095B2

(12) United States Patent
Barlow et al.

(10) Patent No.: US 12,458,095 B2
(45) Date of Patent: Nov. 4, 2025

(54) DIVERGED ENERGY OF COMPRESSED NEGATIVE STIFFNESS HONEYCOMB SHELLS VIA SYNTHETIC NYLON 6 AND 12 MATERIALS

(71) Applicants: Joseph Barlow, Bethlehem, PA (US); Siddhardh Tekumalla, Bethlehem, PA (US)

(72) Inventors: Joseph Barlow, Bethlehem, PA (US); Siddhardh Tekumalla, Bethlehem, PA (US)

( * ) Notice: Subject to any disclaimer, the term of this patent is extended or adjusted under 35 U.S.C. 154(b) by 0 days.

(21) Appl. No.: 19/020,401

(22) Filed: Jan. 14, 2025

(65) Prior Publication Data

US 2025/0151830 A1 May 15, 2025

Related U.S. Application Data

(63) Continuation-in-part of application No. 18/790,704, filed on Jul. 31, 2024, now abandoned.

(60) Provisional application No. 63/531,386, filed on Aug. 8, 2023.

(51) Int. Cl.
*A42B 3/06* (2006.01)

(52) U.S. Cl.
CPC ..... *A42B 3/06* (2013.01)

(58) Field of Classification Search
CPC ..... A41D 13/015; A42B 3/063; A42B 3/06
USPC ..... 2/411
See application file for complete search history.

(56) References Cited

U.S. PATENT DOCUMENTS

| | | | | |
|---|---|---|---|---|
| 2,878,478 | A * | 3/1959 | Kleinman | A42B 3/06 2/414 |
| 3,183,522 | A * | 5/1965 | Groot | A42B 3/14 2/418 |
| 8,132,494 | B1 | 3/2012 | Nguyen et al. | |
| 12,102,159 | B2 * | 10/2024 | Stone | A42B 3/065 |
| 2016/0032997 | A1 * | 2/2016 | Seepersad | F16F 1/3737 267/141 |
| 2017/0127748 | A1 | 5/2017 | Sethumadhavan et al. | |
| 2022/0015488 | A1 | 1/2022 | Adams et al. | |
| 2022/0079280 | A1 | 3/2022 | Laperriere et al. | |

OTHER PUBLICATIONS

Negative stiffness honeycomb—Texas Health Journal, https://www.youtube.com/watch?v=YvNIVKZow_Q.

(Continued)

*Primary Examiner* — Timothy K Trieu
(74) *Attorney, Agent, or Firm* — James R McDaniel

(57) ABSTRACT

Systems, methods, and other embodiments for a sports helmet having a honeycomb assembly, including a sports helmet, wherein the honeycomb assembly is located within an interior of the sports helmet, wherein the honeycomb assembly is capable of at least a 90% honeycomb recovery percentage after the sports helmet has been impacted by a baseball, and wherein the honeycomb assembly includes a first block, a first line, a first connector, a second line, a bar located adjacent to the second line, a third line, a second connector, a fourth line, a second block, and a plurality of beams, wherein each of the plurality of beams is operatively connected to ends of the first line, second line, third line, and bar.

12 Claims, 13 Drawing Sheets

(56) References Cited

OTHER PUBLICATIONS

Negative Stiffness Honeycombs for Recoverable Shock Isolation: D.M. Correa, T.D. Klatt, S.A. Cortes, M.R. Haberman, D. Kovar, and C.C. Seepersad—The University of Texas at Austin.
Honeycomb Structure, Science Direct, Nancarbon and its Composites, 2019, www.sciencedirect.com/topics/materials-science/honeycomb-structure.

* cited by examiner

Nylon 6

| Sample Post Made | N6C | N6F | N6H | N6B | N6E | N6I |
|---|---|---|---|---|---|---|
| IG | 32.22 | 33.63 | 32.76 | 31.69 | 33.03 | 33.55 |
| JH | 32.51 | 33.53 | 33.76 | 31.9 | 33.32 | 33.78 |
| Average | 32.37 | 33.58 | 33.26 | 31.79 | 33.18 | 33.65 |
| Lab Measure | | | | | | |
| Pre-Test | 31.42 | 31.49 | 31.34 | 32.95 | 30.83 | 30.56 |
| Difference | 0.95 | 2.09 | 1.92 | -1.16 | 2.35 | 3.11 |

FIG. 6A

Nylon 12

| Sample Post Made | N12 D | N12 G | N12 H | N12 B | N12 F |
|---|---|---|---|---|---|
| IG | 34.15 | 33.65 | 33.62 | 33.78 | 33.6 |
| JH | 34.19 | 33.69 | 33.54 | 33.95 | 33.87 |
| Average | 34.17 | 33.67 | 33.58 | 33.87 | 33.74 |
| Lab Measure | | | | | |
| Pre-Test | 33.03 | 32.99 | 33.03 | 33.12 | 33.08 |
| Difference | 1.14 | 0.68 | 0.55 | 0.75 | 0.66 |

FIG. 6B

Nylon 6G

| Sample Post Made | N6G A | N6G H | N6G I | N6G E | N6G F |
|---|---|---|---|---|---|
| IG | 34.54 | 33.48 | 33.67 | 33.03 | 33.83 |
| JH | 33.78 | 33.53 | 33.73 | 33.32 | 33.55 |
| Average | 34.16 | 33.51 | 33.7 | 33.17 | 33.69 |
| Lab Measure | | | | | |
| Pre-Test | 33 | 32.66 | 32.72 | 32.21 | 30.36 |
| Difference | 1.16 | 0.85 | 0.98 | 0.96 | 3.33 |

FIG. 6C

| Sample ID | Initial Height (mm) | Final Height (mm) | Recovery (%) |
|---|---|---|---|
| N6A | 31.66 | 25.45 | 80.39 |
| N6D | 33.07 | 24.52 | 74.15 |
| N6GD | 32.44 | 21.10 | 65.04 |
| N6GF | 32.06 | 23.27 | 72.58 |
| N12B | 33.36 | 22.06 | 66.13 |
| N12C | 32.93 | 22.19 | 67.39 |

FIG. 8

| ACE Sample ID | Customer ID | 10 Second Recovery (%) | 30 second Recovery (%) | 60 Second Recovery (%) |
|---|---|---|---|---|
| A24-1394-001-01 | Dry Nylon 6 | 98.29 | 99.48 | 99.90 |
| A24-1394-001-02 | Wet Nylon 6 | 98.48 | 98.98 | 99.25 |
| A24-1394-001-03 | Dry Glass Filled Nylon 6 | 98.16 | 98.71 | 99.32 |
| A24-1394-001-04 | Wet Glass Filled Nylon 6 | 98.35 | 95.68 | 96.15 |
| A24-1394-001-05 | Dry Nylon 12 | 93.00 | 94.05 | 94.47 |
| A24-1394-001-06 | Wet Nylon 12 | 93.87 | 94.50 | 95.03 |

FIG. 9

DIVERGED ENERGY OF COMPRESSED NEGATIVE STIFFNESS HONEYCOMB SHELLS VIA SYNTHETIC NYLON 6 AND 12 MATERIALS

CROSS-REFERENCE TO RELATED APPLICATIONS

This application is a continuation-in-part of U.S. patent application Ser. No. 18/790,704, filed on Jul. 31, 2024, which claims benefit of U.S. Patent Application 63/531,386, filed on Aug. 8, 2023, 2023, the disclosure of which are hereby incorporated by reference in their entirety to provide continuity of disclosure to the extent such a disclosure is not inconsistent with the disclosure herein.

FIELD OF THE INVENTION

It is known that from 1982-to-2015, ~240,000 baseball and softball related Traumatic Brain Injuries (TBI) were recorded (7,270/yr.), with more than 110,000 being U.S. children (3300/yr.) younger than 18 years of age who were treated for baseball head injuries. These statistics have been consistently rising (>12%/yr.) for the past seven years (2015-2022).

The most explored outcome of traumatic brain injury is concussion. Females were on average two-times more likely to sustain a TBI than males. Severity of TBIs varied from mild and returning to the field on the same day, to immediate death. There is poor and misunderstood design, compliance, and use of sport helmets, and time to return-to-play post-concussion guidelines. In addition to new safety sport helmets, there is a need for multifaceted preventive strategies to be implemented to reduce the frequency and burden of these injuries. Such an approach can be more effective than single-component interventions because it tackles the problem from various angles, thereby ensuring a more robust and sustainable solution.

The present invention relates to providing, within the sport helmet, a protective material (Nylon), having less bulkage/mass, an increase in honeycomb recovery percentage, for re-use, and a rate of recapture of the compression materials (all sides) to be within 10-30 seconds and a recovery of the lengths of each side. To contribute to this, the present invention includes combined physical chemistry and engineering means of defining and preparing unique negative stiffness honeycomb structures with recent molecular structure types of Nylon (Nylon 6 [N6], Nylon 6+Glass [N6G], Nylon 12 [N12], and proposed Nylon 12+Glass [N12G]) that are today (vs. 10-years ago, with Nylon 5 and Nylon 11) directly synthesized for consistent honeycomb compositions by the primary molecular species.

FIG. 1 shows the novel honeycomb product design used. Independent lab analysis was done on the novel honeycomb design for unbiased comparison to the known Nylon materials, not considered 8-15 years ago by those skilled in the technology, to make negative stiffness honeycomb products according to the present invention that are malleable and formable, compared to specific synthesized materials for consistent structures.

Based on these observations, a new honeycomb assembly design was developed with N6 and N12 with or without glass for a goal of a compression value of >6800N (Newtons); the use of a protective baseball helmet with 10°-25° exterior angular structures/curves that can redirect and slow down the moving force of a baseball which typically weighs g +/−2 grams by reducing the contact time within the baseball helmet and, most importantly, the batter's head. The resident time of the baseball at the head/helmet is the most critical mathematical variable in order to reduce the total Newtons to a level a honeycomb (N6 or N12) can manage (>80% recovery) effectively. The present invention achieved honeycomb design recovery of 90-96% within 30 seconds, with 85-90% of the full tested Newton compression force.

The skull is thinnest at the side of the head, with a key artery that can cause direct bleeding from a 95-mph baseball, with a single head impact zone and time of impact of 0.001 sec. The force (F) exerted on the batter's head is from a baseball impact lasting ~0.001sec, the total time increased ×10 by helmet design of angle inputs, and therefore does not do excessive damage at one point but distributes the force (Newtons) over a broader area on the head.

Baseball concussion formula:

(\Delta p) is the change in moment (m) is the mass of the baseball (0.145 kg)

(\Delta v) is the change in velocity (from 42.47 m/s to 0 m/s)

(\Delta t) is the time baseball hits the head, e.g. 0.001 sec (Estimated range: 0.004 sec to 0.001 sec)

Using this formula, $$F = \frac{\Delta p}{\Delta t} = \frac{m \cdot \Delta v}{\Delta t} \quad \text{(Eq. 1)}$$

A baseball moving at 95 MPH takes 0.4 seconds to reach (60 feet distance; 15 feet/0.1 second) the batter at home plate. Using Eq. 1, the force (F) of a short hit time of 0.001 seconds, F=m·a=0.145 kg·42500 m/s2=6,163 N (the force of the ball at the head). Added examples of hit times are 0.002 sec=3,080 N, or 0.004 sec=1,540 N. Therefore, the shorter time of the transfer of Newtons is directly related to the batter's head experiencing a full concussion. A direct hit to the head by >1000 N is the initiation of a medical concussion. The actual force time of the baseball to the head of a batter is affected by the angle of the baseball's impact (a curve), or like a spinning baseball pitch (eephus pitch). A concussion can occur at these speeds, but if the ball is forced to turn (or deflect) when it contacts physical items on the sports helmet (i.e., protrusions), the impact force of the baseball on the sports helmet can be further reduced. For example, the use of a sports helmet which includes a plurality of exterior protrusions located along the exterior sides of the sports helmet and above the ear holes (FIGS. 10 and 11) can assist in reducing the impact force of the baseball upon the batter's head. In particular, if one adds 2-to-4 exterior protrusions, wherein a centerline of each protrusion is located at an angle of 15° to 25° from a center area of a honeycomb assembly attached to an interior of the helmet (FIGS. 10 and 11), one can slow down the internal contact with the honeycomb (N6, N6+G or N12 and N12+G) time from 0.001 sec (thereby causing a force of 6.16 KN for the baseball) to 0.004 sec (thereby reducing the force to ~1,540N), which will significantly reduce the likelihood of the batter experiencing a serious concussion.

BACKGROUND OF THE INVENTION

It is known for a structural component heat shield that during its assembly the foam pins and honeycomb materials are inspected during the preparation of the heat shield layers. The local buckling tendency of composite panels has been experimentally evaluated with respect to various design variables, such as the molecular composition, thickness, cell size, and specimen dimension of its honeycomb structures. From the early experimental results, the awareness of buckling was considered in the present invention. Buckling is the sudden deformation of a structural honeycomb that is loaded in compression, which occurs when the compressive load in the honeycomb reaches a critical value. Buckling often occurs suddenly and can cause the unit to reach a critical value. Buckling often occurs suddenly and can produce large (0.5 to 1.5 cm) displacements. This does not always result in yielding or fracture of the material, but buckling is a failure mode since the buckled can no longer support a load (post compression) in the way it was originally intended to be. As shown in FIG. 3, there is an example of a structural member that has buckled due to a high compressive load.

Honeycombs are structurally designed components/columns and are common examples of structures that fail by buckling. Trusses are beams that create a rigid structure for the honeycomb assembly, that limited partial (~85%) compression.

The following conclusions are obtained and are consistent with results from the known prior art. In addition, buckling behavior of the honeycomb structure is due to a compressive load stabilized with smaller cells and composite panels with large cell size honeycomb cores that can cause unstable buckling behavior under compression loading, independent of the composition of the local impact sizes. When the cell size of honeycomb core is large, unstable buckling can occur at the yield point (>90%). It was determined that yield loads become proportional to the panel specimen area but are slightly affected by specimen height. However, the yield stress results of such composite panels now show smaller differences due to the unique design variables of the present invention. The changes made in honeycomb design were in part considered by the prior art, but the inconsistent composition of the primary water within the honeycomb material gives hydrogen bonded connections (like that maintaining the DNA double helix structure). Water concentrations (1-7 wt. %) and in some cases unwanted collective honeycomb fibers cause directional collapse or added rejection for consistent compression and/or recovery.

According to the present invention, it was determined that the compression and recovery actions must be consistent to optimize protection of the baseball at the head of the batter with the honeycomb composition, e.g., Nylon 6 or N6+Glass or N12. These actions may contribute to a faster recovery of the batter because the honeycomb mixture reduces the total Newtons that impact the head at the ear. Reduction to 2000-3000 Newtons interfacing with the head from 5000-6000 Newtons (80-95 MPH) from the baseball does not stop all physical damage but makes the injury more recoverable. For composite panels under local compression loads or impacts, honeycomb structures have unique design variables and have been selected due to local size of compression loads or impacts.

The in-depth discussion in the known prior art defines novel engineering and unique chemistry approaches for Nylon 11 on how to generate a negative stiffness honeycomb material; provided new options to the degree and approach to define the physical structure of the honeycomb shells and a protective sports helmet. It is further known that the Guardian Cap, developed by Guardian Innovations, LLC, Johns Creek, GA (US) was prepared for the functional use of the honeycomb cells, as disclosed in the present invention, within a sports helmet with options to add/remove and inspect the degree of compression that has not recovered, hence remove and replace the honeycomb cells. Physics says that an outer "soft" material of the proper density, stiffness, and energy absorbing properties reduces the initial severity of the impact to minimize concussions. The hard shell has lower forces transmitted to it, and, in turn, conveys lower forces to the interior soft helmet padding and thus lowers the forces to the head.

It is to be noted that Nylon 11 was removed from the present invention and replaced by Nylon 12, in a comparable manner that Nylon 6 replaced Nylon 5. The reasons were the inconsistent composition (for C5 and C11 chemical structures) of production feedstock, and the moisture content of the Nylon that is considered in this approach, via drying. Today, honeycomb cores are commercially manufactured via an expansion process and the corrugation process from composite materials such as glass reinforced plastic (known as fiberglass), carbon fiber reinforced plastic, Nomex Aramide paper reinforced plastic, or from a metal (e.g. aluminum).

Ring-opening polymerization is the preferred chemical process for such commercial production. Nylon 12 exhibits properties between short chain aliphatic nylons and polyolefins. At 178-180° C., the melting point of Nylon 12 is the lowest among polyamides. Its mechanical properties, such as hardness, tensile strength, and resistance to abrasion, are like Nylon 6. Now, low water absorption and density, 1.01 g/mL, results from its relatively long hydrocarbon chain length, which confers its dimensional stability and an almost paraffin-like structure. Nylon 12, at this time, is more chemically resistant and insensitive to such stress cracking.

In a similar manner, caprolactam has 6 carbons which is unique to Nylon 6. When caprolactam is controlled heated to 260° C. with an inert and dry atmosphere of cylinder nitrogen for 4-5 hours, the ring breaks and undergoes polymerization. The molten mass is carefully passed through spinnerets to form fibers of Nylon 6. During polymerization, the amide bond within each caprolactam molecule is broken, with the active groups on each side re-forming two new bonds as the monomer becomes part of the polymer backbone. All Nylon 6 amide bonds lie in the same direction. Note that in this study a Nylon 6 with and without glass composition was used in addition to enhance flexibility of the honeycomb. The term "Glass" in this context of Nylons typically refers to the glass transition temperature (Tg), which is a critical property of polymers. For Nylon 6, the glass transition temperature is 47° C[12]. This temperature is critical because it marks the point where the polymer transitions from a hard, glassy material to a softer, more rubbery state. For honeycomb structures made of Nylon 6, the glass transition temperature is the key factor to determine the conditions under which the material maintains its rigidity and structural integrity.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which:

FIG. 6A is graphical presentation of the measurement of the center of the honeycomb assembly for Nylon 6 before compression, according to the present invention;

FIG. 6B is graphical presentation of the measurement of the center of the honeycomb assembly for Nylon 12 before compression, according to the present invention;

FIG. 6C is graphical presentation of the measurement of the center of the honeycomb assembly for Nylon 6G (Glass) before compression, according to the present invention;

FIG. 8 is graphical presentation of the measurement of the recovery 30 seconds after full compression for Nylon 6 and 12, according to the present invention;

FIG. 9 is graphical presentation of the measurement of the recovery 30 seconds after 85% compression for Nylon 6 and 12, according to the present invention;

DETAILED DESCRIPTION OF THE INVENTION

It is known to construct honeycomb sandwich panels that are composite and constructed by bonding core material of honeycomb structures with thin plate surfaces together. Because honeycomb sandwich panels are lightweight and have high strength performance, they are widely utilized in many fields. However, data on impact resistant properties of such composite panels are not widely publicized (kept private), and the testing methods are therefore not clearly specified.

As a result, in the present invention, the local buckling tendency of composite panels was experimentally evaluated with respect to design variables, such as the thickness, cell size, and specimen dimension of honeycomb structures. It was concluded that under local compressive loading for the honeycomb sandwich panels tested, honeycomb cores are buckled before reaching yielded points and cause the danger of panels being degraded from their original levels. The concerns of consistent composition, design/layout of the honeycomb that in some cases were of inconsistent size/length/thickness, and excess water absorption were considered in the present invention. This is the reason the present invention used a series of Nylons with (WET) and without (DRY) moisture (<3%), prepared from molecular consistent feedstock Nylons, and packaged the testing units in heavy sealed bags when shipped to an analytical lab, and each test was limited in time (<15 min) to pre-measure each Nylon unit installed, set, run compression, stop, run recovery, measure system dimensions for recovery (mm), then replace into the same bag, total time ~15 minutes.

Figure 1:
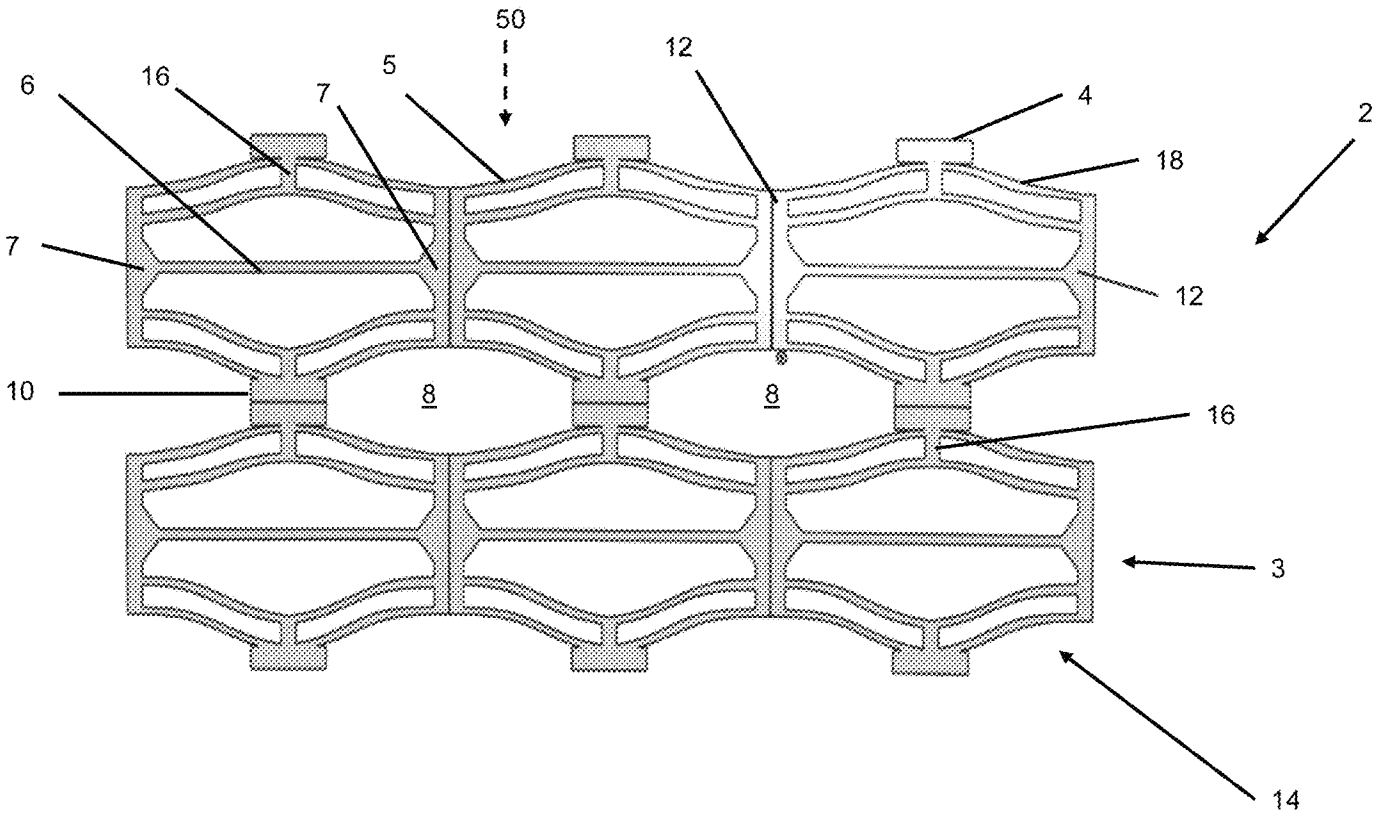
FIG. 1 is a schematic, front view illustration of a honeycomb assembly using Nylon 6 and 12, constructed according to the present invention.
Figure 10:
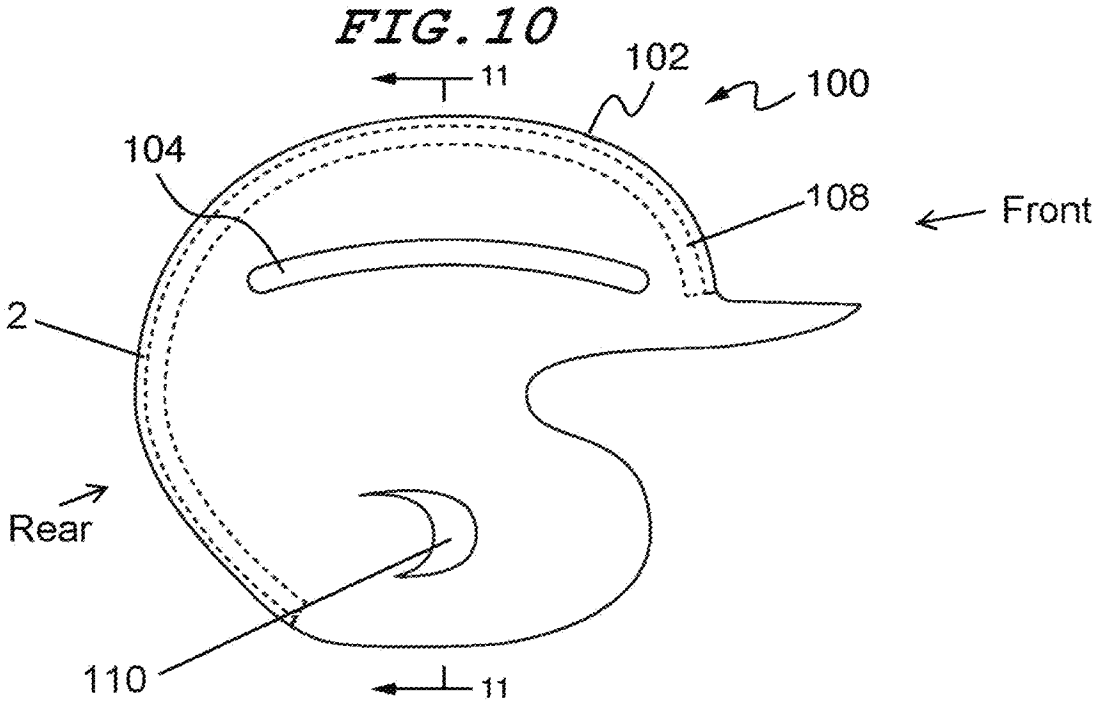
FIG. 10 is a schematic illustration of a right side of a sports helmet having at least one protrusion, according to the present invention.
Figure 11:
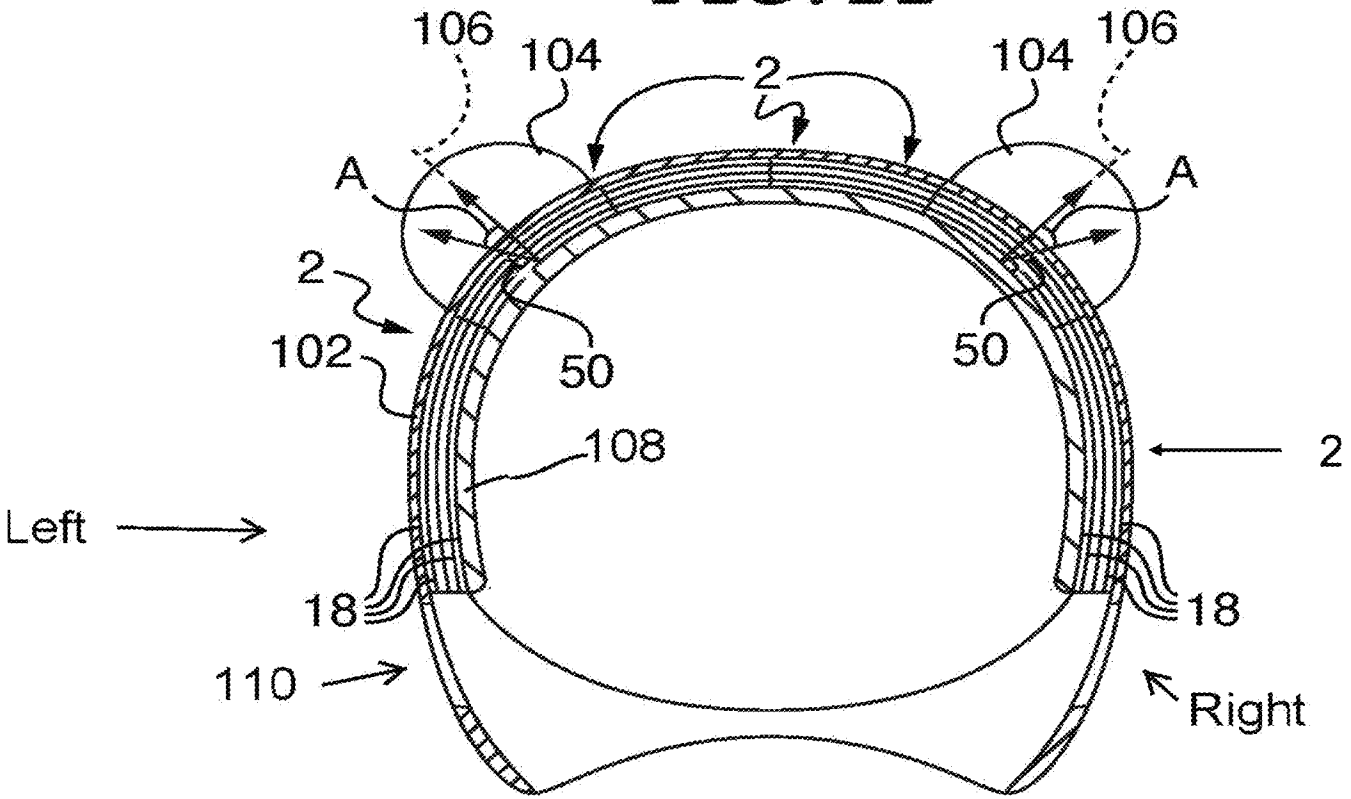
FIG. 11 is a rear view, taken along lines 11-11 in FIG. 10, of the sports helmet having at least one protrusion, according to the present invention.

With respect to FIGS. 1, 10 and 11, there is illustrated a honeycomb assembly 2 constructed according to one embodiment of the present invention. In particular, honeycomb assembly 2 includes, in part, a plurality of honeycomb cells 3 wherein each of the honeycomb cells 3 includes an elongated block 4, a straight bar 6, an opening 8, an elongated block 10, an elongated beam 12, connector 16, and lines 18. Preferably, in one embodiment, honeycomb assembly 2 is constructed of Nylon (Nylon 6 [N6], Nylon 6+Glass [N6G], Nylon 12 [N12], or Nylon 12+Glass [N12G]), as discussed above. Furthermore, honeycomb assembly 2 is constructed using any suitable method such as 3D printing, forming or the like. Finally, as can be seen in FIGS. 1 and 11, the honeycomb assembly 2 includes a center area 50 that runs the length of the honeycomb assembly 2 and equally divides the honeycomb assembly 2 along a width of the honeycomb assembly 2.

A unique aspect of the present invention is that honeycomb assembly 2 can be removed and replaced especially if the honeycomb assembly 2 has experienced a significant compression such as when a baseball impacts the sporting helmet that is equipped with the honeycomb assembly 2. Another unique aspect of the present invention is that a plurality of honeycomb cells 3 can be constructed together to form a larger honeycomb assembly 2 that is designed to be located within an interior portion of a sports helmet.

With respect to elongated blocks 4, blocks are located along an upper ridge 5 of the honeycomb cell 3. In one embodiment, the blocks 4 assist in providing a stable platform so that several honeycomb cells 3 can be stacked upon each other.

With respect to straight bar 6, in one embodiment, straight bar 6 is used to connect two (2) triangles 7 located on beams 12. In one embodiment, the triangles 7 are used to spread out the force exerted on beams 12. In this manner, the beams 12 should not experience any localized forces which could cause the beams 12 to fail.

With respect to opening (or void) 8, in one embodiment, opening (or void) 8 is located within the honeycomb cell 3. In this manner, the opening 8 allows each honeycomb cell 3 of the honeycomb assembly 2 to provide a greater amount of compression and recovery after the compression has been removed from the honeycomb assembly 2. It is to be understood that opening 8 does not include any bars or other similar structures within opening 8.

With respect to elongated block 10, in one embodiment, block 10 is located at the bottom of each honeycomb cell 3. In this manner, block 10 can be used to connect each honeycomb cell 3 to another honeycomb cell 3 in order to form a honeycomb assembly 2 assembly by interacting with blocks 4.

With respect to elongated beam 12, in one embodiment, beam 12 is used to connect each honeycomb cell 3 to another honeycomb cell 3. Furthermore, beam 12 is used to absorb the force of the bar 6 when the bar 6 elongates during compression of the honeycomb cell 3.

With respect to area 14, in one embodiment, the less wide shape of area 14 creates the appearance of a "square" honeycomb with smaller rectangular connectors 16 connecting each line 18.

With respect to connector 16, in one embodiment, shorter connectors 16 are used to connect adjacent lines 18 of the honeycomb assembly to each other. In this manner, if the honeycomb assembly experiences a compression load, connectors 16 assist in spreading out the compression load among all the lines 18. Also, connector 16 is connected to elongated blocks 4 and 10.

Figure 2:
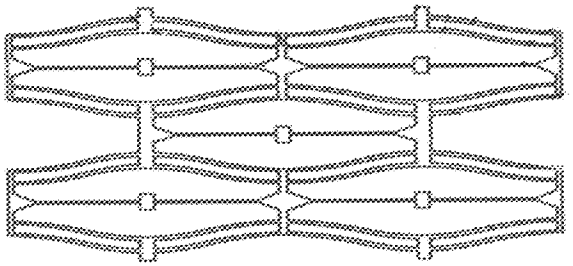
FIG. 2 (Prior Art)
FIG. 2 a schematic, front view illustration of a honeycomb assembly using Nylon 11, constructed according to the prior art.

With respect to FIG. 2, there is illustrated a honeycomb design according to the prior art. As can been seen by comparing the honeycomb assembly 2 in Fig I and the known honeycomb design in FIG. 2, the following are some of the differences between the two designs:

1.) The honeycomb assembly 2 contains larger blocks 4 that are attached to the upper line 18.
2.) A wider bar 6 connecting the two triangles 7 within the honeycomb assembly 2
3.) No bar connecting within the cell 3 connecting the upper and lower portions of the honeycomb cell 3
4.) A larger block 10 underneath the honeycomb cell 3 assists in binding the structure together
5.) Larger beams 12 connect each honeycomb cell 3 of the honeycomb assembly 2
6.) A less wide shape creates the appearance of a square honeycomb with smaller rectangular connectors 16 connecting each line.
7.) A shorter rectangular connector 16 in between lines 18 of honeycomb Wet Versus Dry Honeycomb The absorption of water (2-7%) into the newly made honeycomb during synthesis, during the cooling session or during storage of Nylon 5, 6, 11 and 12 presents a concern because the water can confer its dimensional stability. Dimensional stability is a critical property of materials, including honeycomb structures made from Nylon 5, Nylon 6 and Nylon 12. This is related to the ability of the honeycomb to maintain its dimensions, such as high humidity, temperature and mechanical stress. It was determined that rapid storage and container purged with gaseous nitrogen (low humidity) works best with Nylon 12 vs. Nylon 6, because of its composition. FIG. 9 shows the results of preparing and storage of Nylon 6, Nylon 6+Glass and Nylon 12 Honeycombs under humidity control maintained dimensions after compression (5000 N) and recovery (60 seconds total). When open to 50% humidity (24 hours) the recovery drops to 65% (Nylon 6) and 85% (Nylon 12) post compression and recovery.

Figure 3:
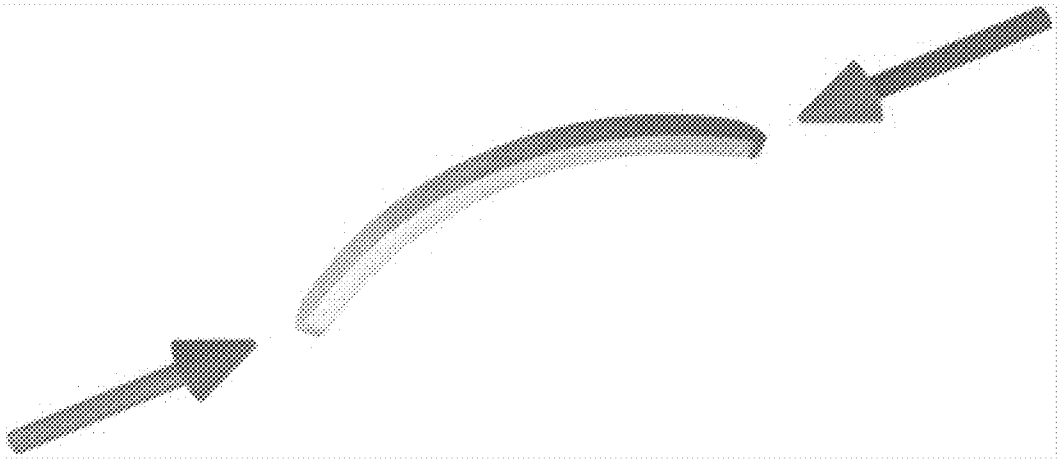
FIG. 3 (Prior Art)
FIG. 3 is a schematic illustration of a structural member that has buckled due to a compressive load, according to the prior art.

With respect to FIG. 3, it is known that honeycomb structures buckled starting at the unstable yield loads. It was found that the honeycomb structures were buckling after stable yield points, and different behaviors can be observed from these two type results. The buckling behaviors were reported as due to compressive load-displacement curves tending to be more stable when the cell size of honeycomb structure is smaller. It was shown that considering the local compression effects of honeycomb sandwich panels, compression strength of the honeycomb structure will become lower than usual when buckling started at yielding loads. Therefore, it is to be understood that it is important to consider the cell size of honeycomb structures as applied to composite panels under local compression loading.

Figure 4:
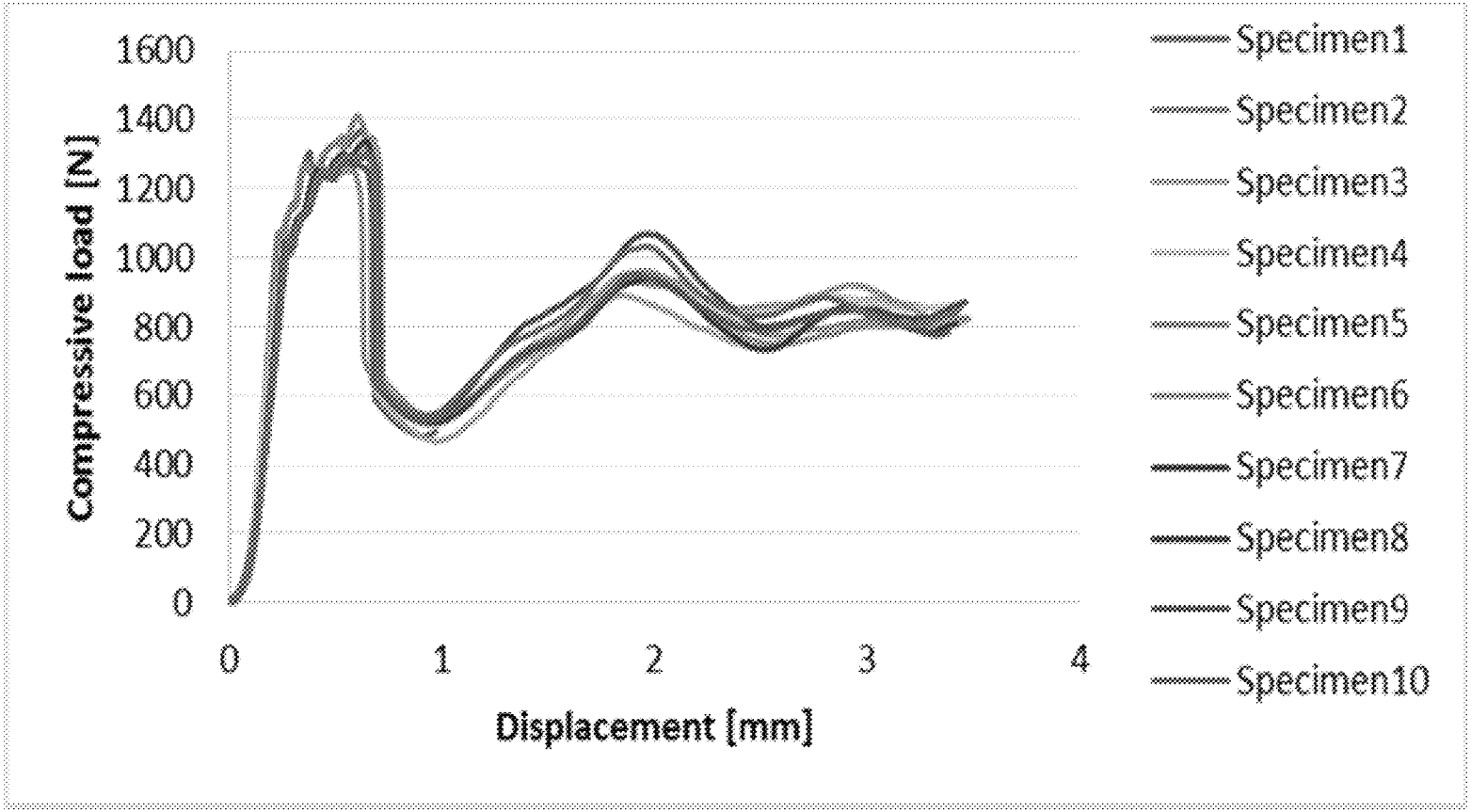
FIG. 4 is a graphical presentation of honeycomb compression results for the honeycomb assembly using Nylon 6 and 12 for full compression to failure and recovery, according to the present invention.

It is further known that the yield loads tend to increase as the height of the honeycomb core is decreased, regardless of the compression area of composite panel specimens with ⅛-inch (3.18 mm) cell size as shown in FIG. 4.

However, considering the cross-sectional area of the honeycomb core, the stress level becomes larger with a smaller compressive area and lower height of specimen. From the results of specimen numbers 5 and 7, one can see that the yield stresses become smaller with respect to the yield load results. This may be because of the 0.003-inch (0.076 mm) foil thickness which is thicker than others use and more compact than others have tested. These observations infer that structural design is critical to compression control. These observations were used in the multiple (3×) measurements pre-and post-the time of production of the honeycomb assembly. Comparing the test results (FIG. 4) of specimen numbers 9 and 10 with a honeycomb cell size of ¼ inch, the yield loads become proportional to the panel specimen area. It was discovered that this was not affected by specimen height. However, the yield stress results of specimen numbers 9 and 10 show different behaviors. This is considered that buckling of ¼-inch panel specimens occurred at the yielding point, which is different from the other two types of composite panel specimens.

Figure 5:
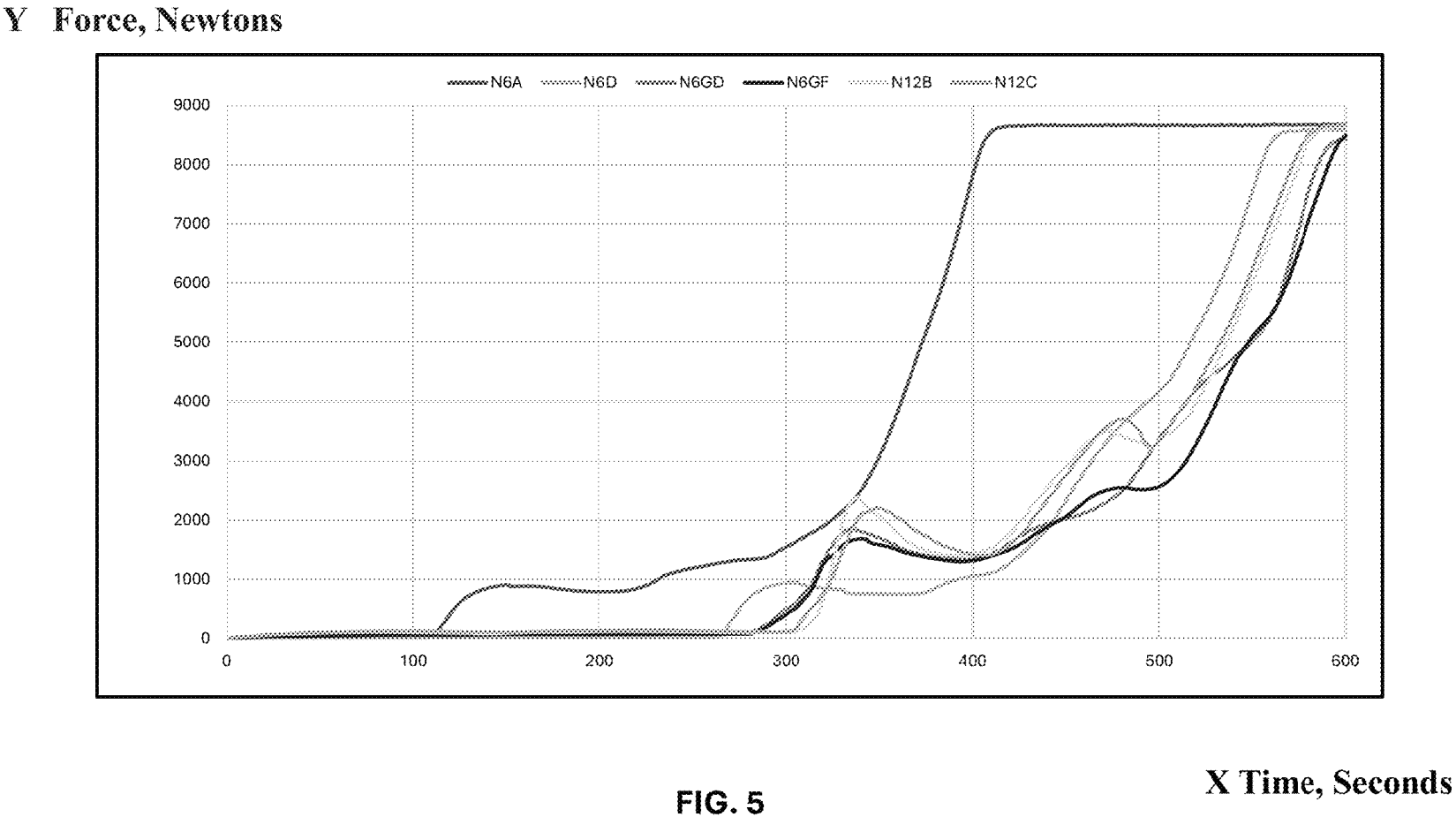
FIG. 5 is a graphical presentation of the Physical Measurements of Nylon 6 (N6), 6+glass (N6GD&F), and Nylon 12 (N12), according to the present invention.

With respect to FIG. 5, FIG. 5 presents the results of full compression of six Honeycomb samples, one dry/one wet of (Nylon 6, Nylon 6+GLASS (G), and Nylon 12), see FIG. 4 and the Chart I below to identify the samples. It was observed that during full compression, the units N6D, N6GD and N12B are wet, the remaining are dry. For example, N6A (dry) is to the far left, and N6D are significantly separated, while the addition of glass units (N6GF (dry) and N6GD) are close together, while N12B (dry) and N12C are upon each other. The relative composition (6 vs 12 carbons) and the addition of glass that adds flexibility to Nylon. The addition of glass to N6 provides substantial performance, closer to N12. A Nylon 12 with Glass (compositions) may well be developed.

CHART 1

| ACE Sample ID | Customer ID | Individual ID's |
|---|---|---|
| A24-1394-001-01 | Dry Nylon 6 | N6A, N6C, N6F, N6H |
| A24-1394-001-02 | Wet Nylon 6 | N6D, N6B, N6E, N6F |
| A24-1394-001-03 | Dry Glass Nylon 6 | N6GF, N6GA, N6GH, N6GI |
| A24-1394-001-04 | Wet Glass Nylon 6 | N6GD, N6GE, N6GF, N6GG |
| A24-1394-001-05 | Dry Nylon 12 | N12B, N12D, N12G, N12H |
| A24-1394-001-06 | Wet Nylon 12 | N12C, N12B, N12E, N12F |

Dimensional stability is a critical property of honeycomb structures made from Nylon 6, and Nylon 12. The ability of the honeycomb to maintain its dimensions, such as high humidity, temperature, and mechanical stress is most important. FIG. 9 shows the recovery results of preparing Nylon 6, Nylon 6+Glass and Nylon 12 Honeycombs under reduced compression (~15% of full compression) and recovery (10-60 seconds) shows the highest level, >94%. When open to 50% humidity (24 hours) the recovery drops to 65% (Nylon 6) and 85% (Nylon 12) post compression and recovery. The results infer that for a 95-mph baseball under force (~6800N) presented to the human head, it would need a honeycomb structure having units with 7900N strength and a helmet with a plurality of protrusions distributed on the exterior sides of the helmet around and above the ears holes of the helmet. These designs are the goal of the present invention in order to minimize a concussion.

Furthermore, to determine the level of force required by the honeycomb assembly 2 to control/limit the force transferred to the brain for a concussion, a test was developed to first measure 3 units per honeycomb assembly 2 for full compression. The honeycomb assembly 2 distribution of force was measured as 900N for Nylon 6, 1800N for Nylon 6+glass, and 2400N for Nylon 12. The modified compression force was defined as 750N for Nylon 6, 1500N for Nylon 6+glass, and 2000N for Nylon 12. The results also show that a dry Nylon 6 has a recovery ~15% greater than the wet Nylon. With Nylon 12, the recovery was identical, while Nylon 6 +Glass recovered 7% more than the dry Nylon. The data has provided an estimated honeycomb assembly 2 control level of just the honeycomb assemblies 2 of 7500N and a residence time of 0.001 sec, while with a helmet angle setup, the resident time of the 95 MPH baseball can be increased to 0.004 sec, decreasing the force to <2000 Newtons, which could be managed by Nylon 12. A final Honeycomb compression of 500-750N may be obtained.

With respect to FIGS. 6A-6C, these Figures are graphical illustrations of the average measurement of 3 units of each designed size of 3 Nylon honeycombs (Nylon 6 (FIG. 6A), Nylon 12 (FIG. 6B), and Nylon 6+GLASS (G) (FIG. 6C), used by the external lab to quantify degree of compression (Newtons and center length) and time (seconds) of recovery (center length), 2-3 minutes after the compression.

It is also known that despite advancements in sports helmet technology, traumatic brain injury is still a grave threat to health and safety. However, the use of 2-4 exterior protrusions 104 located on an exterior of the helmet 102, wherein a centerline 106 of each protrusion 104 is located at an angle A of 15° to 25° from a center area 50 of an adjacent honeycomb assembly 2 (FIGS. 10 and 11), could slow down the internal compression of the Nylon honeycombs and thus reduce the likelihood of the batter experiencing a serious concussion. It is to be understood that this approach may slow down the external and internal contact of the honeycomb assembly 2 for a baseball's impact force at 95 MPH because the locations of the protrusions 104 (in particular, the centerline 106) with respect to an adjacent honeycomb assembly 2 (in particular, the center area 50) will allow the baseball's impact force to be significantly reduced. In particular, the locations of the protrusions 104 with respect to an adjacent honeycomb assembly 2 will allow the baseball's impact force to be efficiently transferred from the protrusion 104 (where the impact force is initially reduced) to the honeycomb assembly 2, where the impact force is further reduced. It is to be understood that the plurality of protrusions 104 should be located on the exterior of the helmet 102 above the ear holes 110. It is also known that expanded polystyrene (EPS) is still today's best common energy absorber. Honeycomb structures are unique and have the desired properties for an effective helmet liner material.

Another unique aspect of the present invention is sports helmet assembly 100. As shown in FIGS. 10 and 11, sports helmet assembly includes, in part, sports helmet 102, a plurality of exterior protrusions 104, and a protrusion centerline 106. In one embodiment, exterior protrusions 104 are created on the exterior of sports helmet 102 through such techniques as printing, forming, molding or the like. It is to be understood that each protrusion 104 has a protrusion centerline 106. As discussed above, the use of 2-4 protrusions 104 located on an exterior of the helmet 102, wherein a centerline 106 of each protrusion 104 is located at an angle A of 15° to 25° from a center area 50 of an adjacent honeycomb assembly 2, could slow down the internal compression of the Nylon honeycomb assemblies 2.

Also, as shown in FIGS. 10 and 11, a plurality of honeycomb assemblies 2 can be attached within an interior portion of the sports helmet 102. Also, a layer of a conventional padding 108 which can be removably attached to one-side of the honeycomb assemblies 2. In this manner, each of the honeycomb assemblies 2 can be removably attached to the interior of the sports helmet 102.

A unique aspect of the present invention is the attachment of each honeycomb assembly 2 within the interior of the helmet 2. As shown in FIGS. 10 and 11, each honeycomb assembly 2 is removably attached to the interior of the helmet 102 in a direction from the rear (Rear in FIG. 10) to the front (Front in FIG. 10) so that a centerline 106 of each protrusion 104 is located at an angle A of 15° to 25° from a center area 50 of an adjacent honeycomb assembly 2. In one embodiment, there is illustrated five (5) honeycomb assemblies 2. It is to be understood that each honeycomb assembly 2 will include a center area 50, but for clarity's sake, only two (2) of the center areas 50 are shown in FIG. 11. Also, as shown in FIG. 11, the cross-sectional view of FIG. 11 shows each line 18 of each honeycomb assembly 2 in that each line 18 extends along the length of each honeycomb assembly 2 (See FIG. 1). Other honeycomb assemblies 2 can also be removably attached to the interior of the helmet 102 in order to cover the portion of the helmet 102 from the right side (Right in FIG. 11) to the left side (Left in FIG. 11). The key aspect being that at least one honeycomb assembly 2 is located close enough to (adjacent to) each protrusion 104 so that the centerline 106 of each protrusion 104 is located at an angle A of 15° to 25° from a center area 50 of an adjacent honeycomb assembly 2.

Based on the above observations review, a new protective baseball helmet design with interior structures is proposed to control >85% of a moving force (e.g., from a 147+/−2 grams baseball), leaving ~21.8-foot pounds (28.5Nm) to directly hit the player's head, according to one embodiment of the present invention. It is known in the 1990's, 59 Ft LBS (~80 Nm) can be considered lethal. This injury, 21.8 Ft LBS, could still cause a minor concussion. The most dangerous place to be hit is on either side of our head, just above the ears. The skull is thinnest at this location, and there is a key artery that can burst and cause direct bleeding in the brain. The speed of a 95-mph fastball is approximately 42.5 m/s. With an estimated head impact time of 0.001 seconds, it has been determined that the deceleration (a) as:

a=vt=42.5 m/s 0.001 s=42,5 m/s 0.001s=42500 m/s2a=tv=0.001s42.5m/s−4500m/s2.

The mass of a professional baseball is 0/145 kg.

So, the force (F) exerted on the batter's head is;

F=ma=0.145 kg 42500 m/s2=6162.5 Newtons (or 6.16 kN).

Important note: This assumed that the baseball contact time (that today is defined as 0.001 seconds for 95 mph), as 0.02 seconds of contact, therefore using the same formulas today, resulted in a mathematical force of the baseball at only 313N (vs. 6,162N), with a 65% recovery.

Conversely, in the present invention, the full compression recovery for N6, N6+G, and N12 ranged from 66 to 80%, and recovery >95% (all Nylons) with an 85-95% compression, as discussed above. Honeycomb structures have the desired properties for an effective helmet liner material. See FIGS. 8 and 9 for compression-100% vs 85% results, and honeycomb recovery post compression. A unique aspect of the present invention is that the recovery of ~95% was unexpected vs. ~65%.

Figure 7:
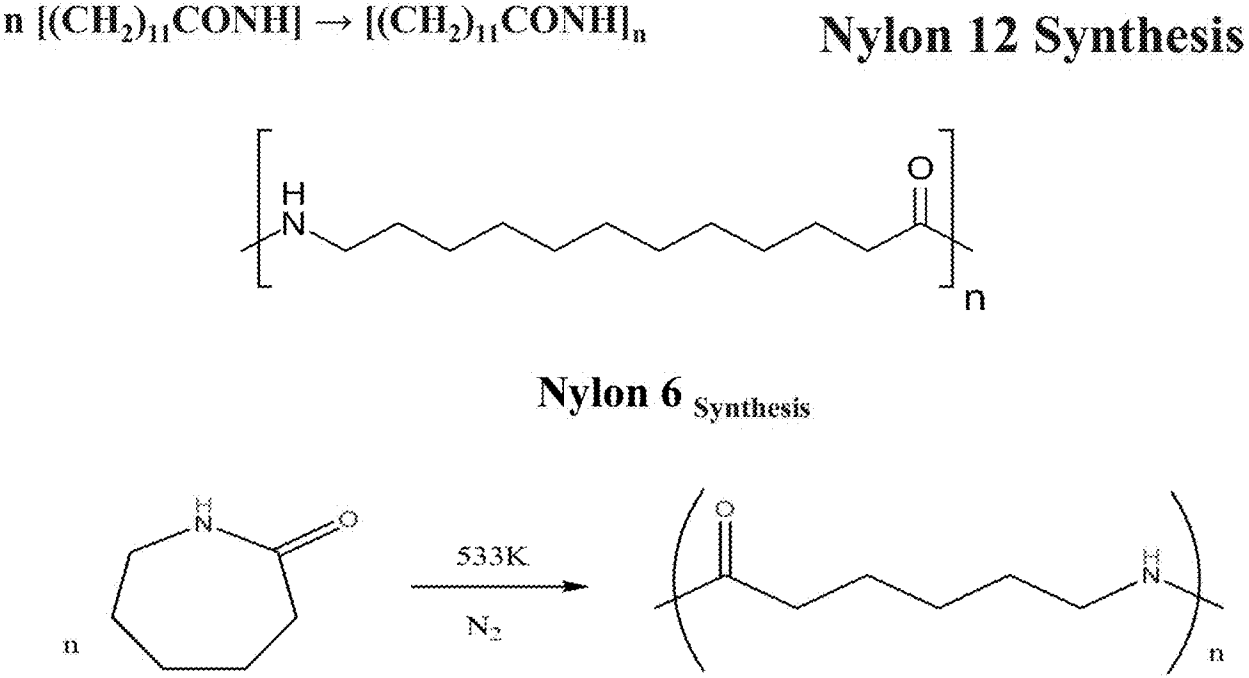
FIG. 7 illustrates the chemical structure of Nylon 6 synthesized by ring-opening polymerization of caprolactam, according to the present invention.

With respect to FIG. 7, it is known that to prepare commercial Nylon 12, it starts with ring-opening polymerization of laurolactam at 260-300° C. (ring opening can be carried out by anionic initiators). Ring-opening polymerization is today the preferred method. Nylon 12 exhibits properties between short chain aliphatic nylons (e.g., nylon 6) and polyolefins. At 178-180° C., the melting point of Nylon 12 is the lowest among polyamides. Its mechanical properties, such as hardness, tensile strength, and resistance to abrasion, are like those of Nylon 6. Low water absorption and density, 1.01 g/mL, result from its relatively long hydrocarbon chain length, which confers it's dimensional stability and an almost paraffin-like structure, was found to be very useful. It was determined that Nylon 12 is chemically resistant and insensitive to stress cracking.

As also shown in FIG. 7, Nylon 6 is commercially synthesized by ring-opening polymerization of caprolactam. Caprolactam has 6 carbons, hence Nylon 6. When caprolactam is heated to 533 K (259.85° C.) in an inert atmosphere of dry nitrogen for 4-5 hours, the ring breaks and undergoes polymerization. The molten mass is passed through spinnerets to form fibers of Nylon 6. During polymerization, the amide bond within each caprolactam molecule is broken, with the active groups on each side re-forming two new bonds as the monomer becomes part of the polymer backbone. The term "glass" in the context of Nylon 6 refers to the glass transition temperature (Tg), which is a critical property of polymers. For Nylon 6, the glass transition temperature is 47° C. For honeycomb structures such as Nylon 6, the glass transition temperature is the key factor to determine the conditions under which the combined materials (Nylon 6/Nylon 12) could put forth their optimum rigidity and structural integrity.

Tangible Form of the Honeycomb Idea

Nylon 11 was the best available material for recovery post a controlled compression. In particular, the data infers a compression recovery of 65%, losing 35% to the structure design. No reuse of the filled batting helmet is allowed. However, the current goal of >90% compression recovery is required for the next level of minimal injury observed and is the goal of the present invention. A baseball moving at 95 mph has about 87-foot pounds of kinetic energy. The goal of preparing a new safety baseball helmet is to stop ~90% of the moving force of a baseball that impacts the helmet at the $2^{nd}$ use, thereby allowing ~9-foot pounds to hit the player's head to cause less of a major injury, if possible. Hence a honeycomb concussion guard should be >95% efficient/recovery, the compressed honeycomb units should be replaced to minimize health issues.

It is also known that negative stiffness honeycombs are architected metamaterials that utilize elastic buckling to absorb mechanical energy. Relative to conventional honeycomb materials, they offer the ability to recover their initial configuration and offer repeatable mechanical energy absorption. In particular, fully recoverable negative stiffness honeycombs are fabricated from thermoplastic and metallic parent materials. The honeycombs are subjected to a quasi-equilibrium process and impact loading to demonstrate both predictability and repeatability of their energy absorption characteristics across a variety of loading conditions. Results indicate that their honeycomb design offers ideal shock isolation by thresholding the acceleration of an isolated mass at a predetermined level and that this thresholding behavior is highly repeatable if the magnitude of the mechanical energy imparted to the system does not exceed the energy absorption capacity of the honeycomb. The process occurs at a pace that allows the system to adjust and maintain a uniform condition throughout, thereby avoiding sudden changes or gradients in properties like pressure or temperature.

In one embodiment of the present invention, the process of the present invention was tested by using N6, N6+glass and N12 with a modified honeycomb (FIG. 1) structure. The use of N12+glass for the honeycomb design of the present invention could be significant at controlling the total force of impact via unique physical-chemistry design of the honeycomb assembly, allowing a space, via less items, to permit distribution of external force, which achieved >95% overall recovery at the reduced compression limit. The use of a modified helmet to physically divert the baseball (force) by using multiple 15°+/−10° angle devices on each side of the helmet could also be used.

Sample Storage

Samples of the honeycomb assembly were singularly kept in heavy duty plastic bins with a latched hinge lid and stored with four desiccant packets per lid to control transfer of moisture (atmospheric to the honeycomb assembly) with room humidity of 35-40%. Nylons 6 and 12 are sensitive to humidity because humidity can affect the physical and chemical properties of the Nylon. In particular, the impact of materials like Nylon 6 or 12 on honeycomb structures is a complex topic, particularly when considering the presence of water. Honeycomb structures are widely used in various engineering applications due to their lightweight and high strength-to-weight ratio. When it comes to the influence of water, the performance of these structures can be significantly affected. Nylon, being a type of polyamide, has a degree of water absorption which can lead to changes in its mechanical properties. For instance, the presence of water can cause swelling, which might affect the dimensional stability of the honeycomb structure. Additionally, water can act as a plasticizer for Nylon, potentially reducing its stiffness and strength. In the present invention, the Nylon was "heated" in the 3D Printer—then enclosed it for shipping. In the present invention, to what degree of impact the humidity had on the design's utility was tested for compression, recovery, and storage, identifying the units as WET vs. DRY, based on their labeled packaging.

Sample Evaluation

Honeycomb assembly samples were handled with nitrile gloves. Each sample was physically measured along 15 uniform reference points using a digital caliper which measured two hundredths of a millimeter. The mathematical average was calculated for each measurement point; in each material, to define the average. The irregularities between samples were, +/−0.3 millimeter, therefore this defined the four similar samples with identical size and weight.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly stated otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein or in the claims.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun.

Other embodiments are within the following claims. Therefore, the patent may not be interpreted to be limited to the specific examples or embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A sports helmet having a plurality of honeycomb assemblies, wherein the sports helmet comprises:

a sports helmet;

a plurality of protrusions attached along an exterior portion of the sports helmet, wherein each of the plurality of protrusions includes a centerline; and a plurality of honeycomb assemblies attached along an interior of the sports helmet, wherein each of the plurality of honeycomb assemblies includes a center area, wherein the centerline of each protrusion is located at an angle of 15° to 25° from the center area of one of the plurality of honeycomb assemblies, and wherein each of the pluralities of honeycomb assemblies includes a plurality of honeycomb cells having a plurality of openings located between each honeycomb cell, and wherein the honeycomb assembly is constructed of Nylon 12+Glass having a moisture content of less than 3%, and each honeycomb cell comprises;

a first block, a first line operatively connected along a center portion of the first line to one end of the first block, a first connector having a first end and a second end, wherein the first end of the first connector is operatively connected to the center portion of the first line and the first block, a second line operatively connected along a center portion of the second line to the second end of the first connector, wherein the second line is parallel to the first line, a horizontal bar located adjacent to the second line, a third line located adjacent to the horizontal bar, a second connector having a first end and a second end, wherein the first end of the second connector is operatively connected to a center portion of the third line, a fourth line operatively connected along a center portion of the fourth line to the second end of the second connector, wherein the fourth line is parallel to the third line, a second block operatively connected along a center portion of the fourth line and the second end of the second connector to one end of the second block, wherein the second block is configured to be located upon the first block one of the plurality of honeycomb cells, and a plurality of beams, wherein each of the plurality of beams is operatively connected to ends of the first line, second line, third line, fourth line, and bar.

2. The sports helmet, according to claim 1, wherein each of the plurality of honeycomb assemblies further comprises:

a plurality of triangles located between the bar and each of the plurality of beams.

3. The sports helmet, according to claim 1, wherein each of the plurality of honeycomb assemblies is constructed by 3D printing or forming.

4. A sports helmet having a honeycomb assembly, wherein the sports helmet comprises:

a sports helmet;

a plurality of protrusions attached along an exterior portion of the sports helmet, wherein each of the plurality of protrusions includes a centerline; and a plurality of honeycomb assemblies attached along an interior of the sports helmet, wherein each of the plurality of honeycomb assemblies includes a center area, wherein the centerline of each protrusion is located at an angle of 15° to 25° from the center area of one of the plurality of honeycomb assemblies, and wherein each of the plurality of honeycomb assemblies includes a plurality of honeycomb cells having a plurality of openings located between each honeycomb cell, and wherein the honeycomb assembly is constructed of Nylon 6+Glass having a moisture content of less than 3%, and each honeycomb cell comprises;

a first block, a first line operatively connected along a center portion of the first line to one end of the first block, a first connector having a first end and a second end, wherein the first end of the first connector is operatively connected to the center portion of the first line and the first block, a second line operatively connected along a center portion of the second line to the second end of the first connector, wherein the second line is parallel to the first line, a horizontal bar located adjacent to the second line, a third line located adjacent to the horizontal bar, a second connector having a first end and a second end, wherein the first end of the second connector is operatively connected to a center portion of the third line, a fourth line operatively connected along a center portion of the fourth line to the second end of the second connector, wherein the fourth line is parallel to the third line, a second block operatively connected along a center portion of the fourth line and the second end of the second connector to one end of the second block, wherein the second block is configured to be located upon the first block one of the plurality of honeycomb cells, and a plurality of beams, wherein each of the plurality of beams is operatively connected to ends of the first line, second line, third line, fourth line, and bar.

5. The sports helmet, according to claim 4, wherein each of the plurality of honeycomb assemblies further comprises:

a plurality of triangles located between the bar and each of the plurality of beams.

6. The sports helmet, according to claim 4, wherein each of the plurality of honeycomb assemblies is constructed by 3D printing or forming.

7. A sports helmet having a plurality of honeycomb assemblies, wherein the sports helmet comprises:

a sports helmet;

a plurality of protrusions attached along an exterior portion of the sports helmet, wherein each of the plurality of protrusions includes a centerline; and a plurality of honeycomb assemblies attached along an interior of the sports helmet, wherein each of the plurality of honeycomb assemblies includes a center area, wherein the centerline of each protrusion is located at an angle of 15° to 25° from the center area of one of the plurality of honeycomb assemblies, and wherein each of the pluralities of honeycomb assemblies includes a plurality of honeycomb cells having a plurality of openings located between each honeycomb cell, and wherein the honeycomb assembly is constructed of Nylon 6 having a moisture content of less than 3%, and each honeycomb cell comprises;

a first block, a first line operatively connected along a center portion of the first line to one end of the first block, a first connector having a first end and a second end, wherein the first end of the first connector is operatively connected to the center portion of the first line and the first block, a second line operatively connected along a center portion of the second line to the second end of the first connector, wherein the second line is parallel to the first line, a horizontal bar located adjacent to the second line, a third line located adjacent to the horizontal bar, a second connector having a first end and a second end, wherein the first end of the second connector is operatively connected to a center portion of the third line, a fourth line operatively connected along a center portion of the fourth line to the second end of the second connector, wherein the fourth line is parallel to the third line, a second block operatively connected along a center portion of the fourth line and the second end of the second connector to one end of the second block, wherein the second block is configured to be located upon the first block one of the plurality of honeycomb cells, and a plurality of beams, wherein each of the plurality of beams is operatively connected to ends of the first line, second line, third line, fourth line, and bar.

8. The sports helmet, according to claim 7, wherein each of the plurality of honeycomb assemblies further comprises:

a plurality of triangles located between the bar and each of the plurality of beams.

9. The sports helmet, according to claim 7, wherein each of the plurality of honeycomb assemblies is constructed by 3D printing or forming.

10. A sports helmet having a honeycomb assembly, wherein the sports helmet comprises:

a sports helmet;

a plurality of protrusions located along an exterior portion of the sports helmet, wherein each of the plurality of protrusions includes a centerline; and a plurality of honeycomb assemblies attached along an interior of the sports helmet, wherein each of the plurality of honeycomb assemblies includes a center area, wherein the centerline of each protrusion is located at an angle of 15° to 25° from the center area of one of the plurality of honeycomb assemblies, and wherein each of the pluralities of honeycomb assemblies includes a plurality of honeycomb cells having a plurality of openings located between each honeycomb cell, and wherein the honeycomb assembly is constructed of Nylon 12 having a moisture content of less than 3%, and each honeycomb cell comprises;

a first block, a first line operatively connected along a portion of the first line to one end of the first block, a first connector having a first end and a second end, wherein the first end of the first connector is operatively connected to the first line, a second line operatively connected along a portion of the second line to the second end of the first connector, a bar located adjacent to the second line, a third line located adjacent to the bar, a second connector having a first end and a second end, wherein the first end of the second connector is operatively connected to the third line, a fourth line operatively connected along a portion of the fourth line to the second end of the second connector, a second block operatively connected along a portion of the fourth line to one end of the second block, wherein the second block is configured to be located upon the first block one of the plurality of honeycomb cells, and a plurality of beams, wherein each of the plurality of beams is operatively connected to ends of the first line, second line, third line, and bar.

11. The sports helmet, according to claim 10, wherein each of the pluralities of honeycomb assemblies further comprises:

a plurality of triangles located between the bar and each of the plurality of beams.

12. The sports helmet, according to claim 10, wherein each of the pluralities of honeycomb assemblies is constructed by 3D printing or forming.

* * * * *